United States Patent [19]

Pace, Sr.

[11] 3,990,341

[45] Nov. 9, 1976

[54] ARM OPERATED TONE VARIATION DEVICE

[76] Inventor: Jaye E. Pace, Sr., 701 Logan St., Pottstown, Pa. 19464

[22] Filed: Mar. 31, 1975

[21] Appl. No.: 563,350

[52] U.S. Cl. ..... 84/313; 84/297 R; 84/312

[51] Int. Cl.[2] ..... G10D 3/00

[58] Field of Search ..... 84/312, 313, 297–303

[56] References Cited

UNITED STATES PATENTS

| | | | |
|---|---|---|---|
| 357,283 | 2/1887 | Jenison | 84/303 |
| 3,457,821 | 7/1969 | McCarty et al. | 84/313 |
| 3,479,917 | 11/1969 | Zitnik et al. | 84/312 |

FOREIGN PATENTS OR APPLICATIONS

| | | | |
|---|---|---|---|
| 433,136 | 12/1911 | France | 84/302 |
| 468,247 | 4/1914 | France | 84/297 R |

*Primary Examiner*—John Gonzales

[57] ABSTRACT

This invention relates to musical instruments, more particularly the invention has reference to stringed instruments, primarily the amplified guitar. The main object of this invention is to provide an instrument of the character described, which will permit a musician to play bass and guitar simultaneously, by operation of an upright lever device. It is a object of the invention in this regard to so design the instrument, so that while both hands are occupied, either by strumming or plucking while chording, he is able to pull the lever with his arm to achieve a tone as described in the instructions of operation of the arm operated musical string tensing device, hereinafter referred to as the Pace Bace.

1 Claim, 5 Drawing Figures

ARM OPERATED TONE VARIATION DEVICE

Other objects of the invention are that the Pace Bace of the character described will be simple in design, capable of manufacture at a relatively low cost, considering the versatility thereof, and adapted for trouble free operation over a long period of time, musically acceptable and easy to play.

A further object is that said Pace Bace can be mounted directly onto the instrument as a permanent fixture.

Another object of the invention, is that it will have two limiting arms to simplify its function, and for a more accurate performance. Yet another object is to provide a removable upright lever when the Pace Bace is not being used, so as to not interfer with normal use of the guitar.

Other objects would become apparent to those skilled in the art, in the light of the following descriptions and drawings.

BACKGROUND OF THE INVENTION

1. Field of the Invention

This invention relates to the field of music. More particularly, this invention relates to the guitar and the like in its revolutionary method of playing rhythm guitar and bass simultaneously on the same instrument. Still more particularly, this invention relates to the simplified rhythm and bass guitar which requires very simple instruction. The Pace Bace is not limited to the field of country and western music, but is also useful in jazz, commercial, and rock type music.

2. Description of Prior Art

So far as is known, this simple method of playing bass patterns simultaneously with rhythm guitar described and claimed here in has not been known heretofore, this invention relates to using only one neck on the guitar; where as in a prior invention the subjects involved used a "twin-necked" system or an individual foot pedaled bass instrument that would be not connected directly to the single necked guitar. Such prior known twin neck guitars resulted in the loss of either bass while guitar is being played or guitar while bass is being played.

Also, in the country and western, bass patterns are obtained by plucking the fifth and sixth strings of the guitar resulting in a higher pitched bass pattern. The Pace Bace uses only one string to create the same in a lower pitched bass sound, plus the versatility of walking sound as the chord is sustained.

SUMMARY OF INVENTION

This invention relates to a new guitar method which would enable the guitarist to play bass and guitar simultaneously, adding an innovated dimension to his playing a ability. With the present conventional method of playing the guitar, there are limitations to the versatility of the instrument, but by using the Pace Bace a chord can be sustained while the base pattern can fluctuate, by merely moving the upright lever of the Pace Bace with the musicians arm at the elbow. There are two basic positions in which the limiting arms are set. This provides an automatic setting of the string tone in conjunction with the chord being played on the guitar.

The Pace Bace can be used on a four stringed guitar by removing the fourth string and replacing it with a bass string attached to the Pace Bace. It can also be used on a six string guitar by replacing the sixth string with a bass string. The same thing applies to seven or 12 string guitars, by replacing the seventh or twelfth string with a bass string, or can be used as a single string solo bass guitar musical instrument, by using the Pace Bace mounted to a fretted board, with an electrified pickup without the use of other strings.

The Pace Bace can also be hooked up to any of the other strings to acquire other effects as will be evident to a person skilled in the use of the guitar.

BRIEF DESCRIPTION OF DRAWINGS

In the drawings wherein like numerals are employed to designate like parts throughout.

DESCRIPTION OF THE PREFERRED EMBODIMENTS

Figure 1:
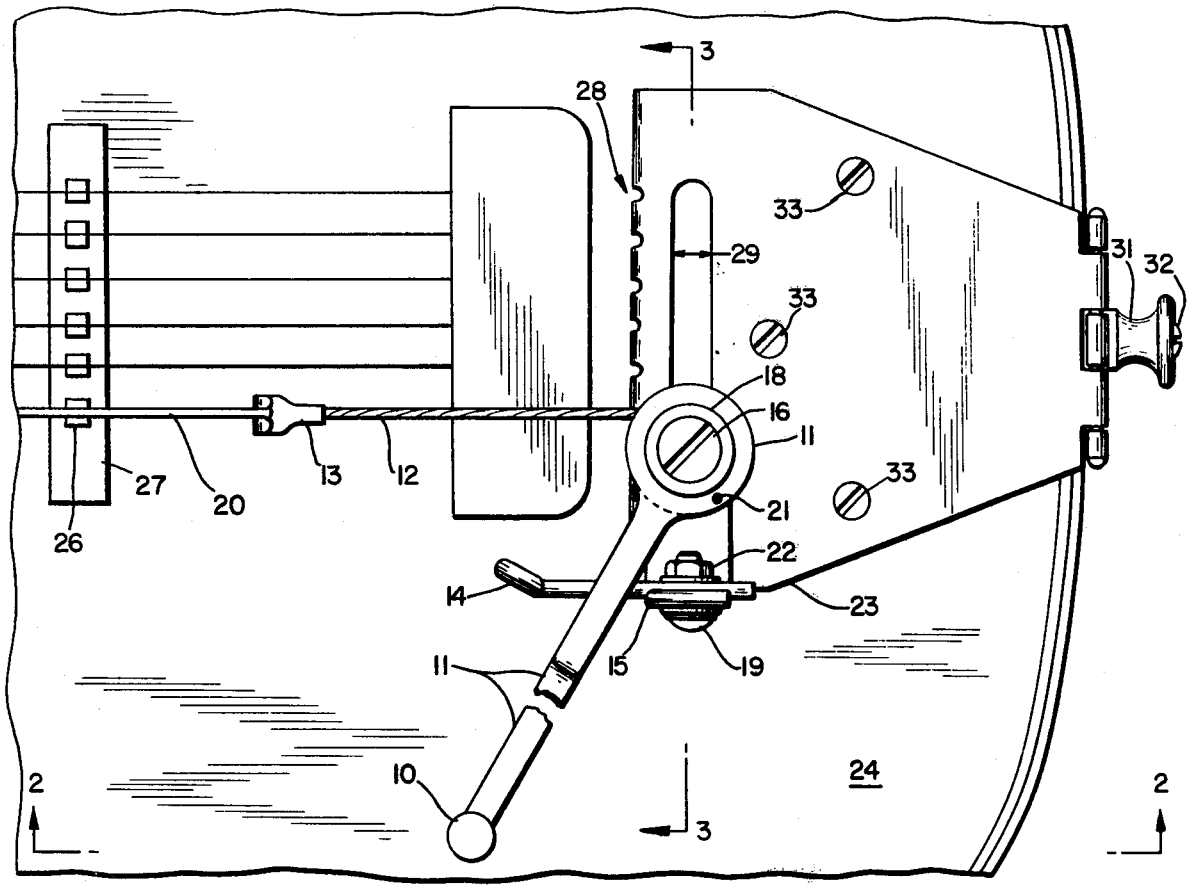
FIG. 1. Plan view of a Pace Bace arm lever device constructed in accordance with this invention attached to a guitar body.

As is well known the musical instrument known as the guitar is widely played as a solo or rhythm instrument. The purpose of the present invention is to add to the scope of the guitar, another dimension. Heretofore, it has been necessary for the guitarist to be backed by a bassist to add depth to the music. By mounting the Pace Bace to the guitar, as will be described in the numerical explanation of the invention, the musician can achieve simulative bass accompaniment while playing the guitar. The present invention has been devised to permit easy and rapid attachment and de-tachment of the Pace Bace to the guitar by the musician without prior mechanical knowledge. If for example the guitarist prefers to re-attach the Pace Bace to a different guitar, there is no interference to the guitar from which it is being removed.

As shown in the drawing, FIGS. 1–5, the subject Pace Bace is to be secured to the body of the guitar, 24,. The Pace Bace is equipped with string holding slots, 28, as in FIG. 5, to replace the string holding tailpiece, if any, that is removed from the guitar, 24,. In the arrangement shown in FIGS. 1–2–3, the Pace Bace main support structure, 23, is shown secured to the guitar, 24, which provides a sturdy mounting surface for the Pace Bace. An important advantage of the present invention is the ability of the Pace Bace to be secured to the strap holder, 31, or other portion of the guitar body, 24, without any appreciable damage to the guitar, 24, and to be detached without any appreciable damage to the guitar, 24, if it should be desired to remove same for any purpose.

Figure 2:
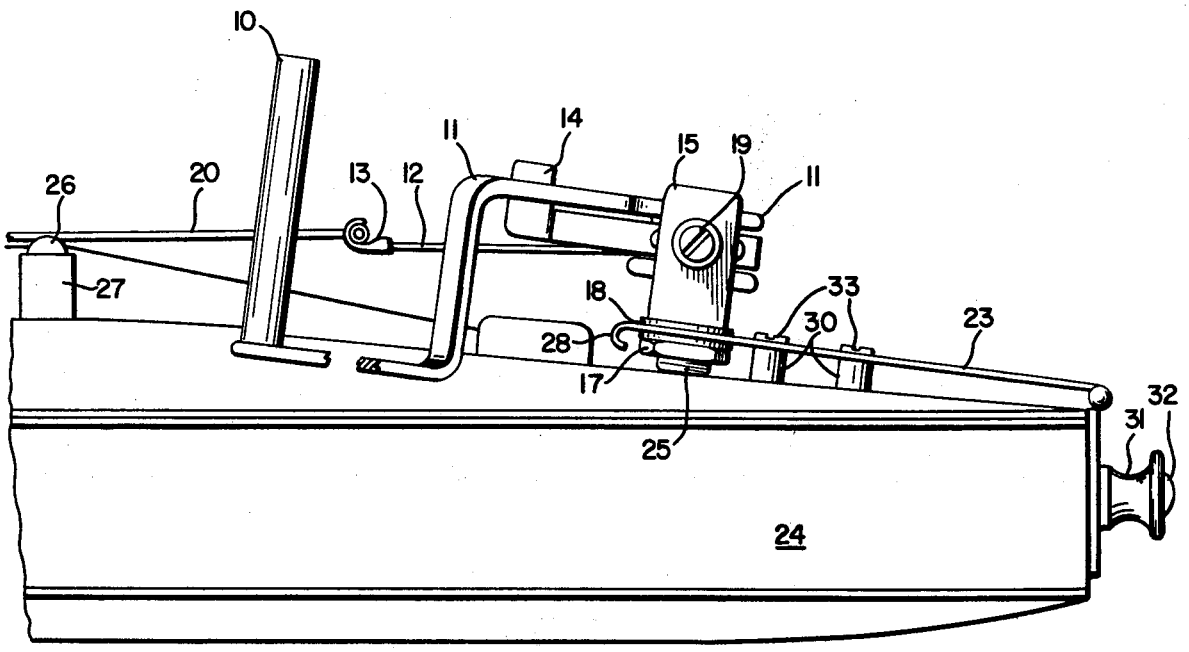
FIG. 2. Elevation of the device shown in FIG. 1.
Figure 3:
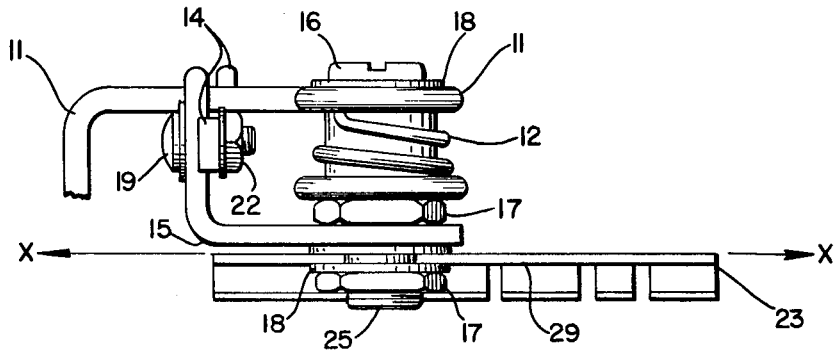
FIG. 3. End view of the device shown in FIGS. 1 and 2.

The main support structure, 23, is designed to position a Pace Bace generally below the string holder plate. Secured to the support structure, 23, a main pivot shaft, 25, is inserted through a pivot shaft adjustment slot, 29,. A rear limiting lever, 15, washer, 18, and upper hexagonal nut, 17, FIG. 3, are slipped over the pivot shaft, 25. This secures the pivot shaft, 25, to the support structure, 23, and allows for later string, 20, alignment with the string guide, 26, on the string guide support bridge, 27, FIGS. 1–2,. An adjustable forward limiting arm, 14, is secured to the rear limiting arm, 15, by a retainer screw, 19, and hex nut, 22, as shown in FIGS. 1–2–3,. Secure removable upright lever, 10, FIG. 2, to unitized spool and lever, 11. Slide unitized spool and lever, 11, over main pivot shaft 25, with the cable, 12, in a counter clockwise position as in FIG. 1. Said position is mandatory to act as an automatic spring back action to unitized spool and lever assembly, 11,. Follow by washer, 18, held by retaining screw, 16, to secure assembly in position, as in FIGS. 1–3.

The main support structure, 23, is now ready to attach to the guitar, 24,. Remove screw, 32, from guitar, 24, thereby releasing strap holder, 31, and any existing tailpiece if present. If existing tailpiece is also a string holding device, remove attached strings. Position Pace Bace over rear section of guitar, 24, as in FIGS. 1–2. Align opening on hinge flap, 23, with screw, 32, opening, replace strap holder, 31, and secure to the guitar, 24, with screw, 32,. Re-attach loosened strings, if any, to string slots, 28, on the main support structure, 23,. Retune strings. The bass string, 20, as explained herewith, can be strung at this time over the string guide, 26, FIGS. 1–2, and attached to the string holding device, 13, and tensioned with the existing guitar machine. The bass string 20, is commercially available specifically for the electric string bass instrument. In the final stages of this invention, the Roto Sound Music String known as Jazz Bass Second or D String No. r.s. 772 has proven to be most successful. The Pace Bace should be lined up with the string guide, 26, FIGS. 1–2, on the string guide support bridge, 27, as in FIGS. 1–2. Rear limiting arm, 15, can be positioned now.

Figure 4:
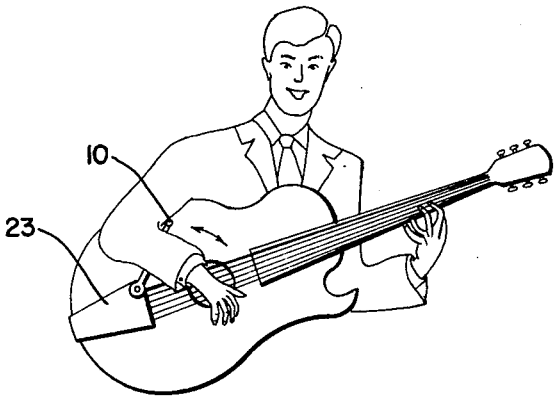
FIG. 4. Guitarist in a normal playing position for the operation of the Pace Bace.
Figure 5:
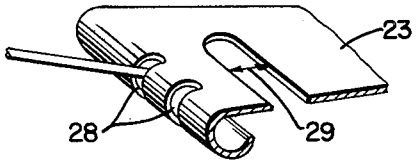
FIG. 5. Partial perspective showing slots for attaching the regular guitar strings if holder is not provided or has been removed.

The guitar, 24, should be held by the musician in his natural playing position, as shown in FIG. 4. Upright lever, 10, FIGS. 1–2–4, should be rested comfortably against the inside angle of the musician elbow, FIG. 4. Rear limiting arm, 15, FIGS. 1–2, is rested against the unitized spool and lever, 11, and hex nuts, 17, FIG. 3, are tightened to the main pivot shaft, 25, to lock sandwiched rear limiting arm, 15, in position. Hex nuts, 17, should be sufficiently tightened to prevent backward slippage of the upright lever, 10, and the unitized spool and lever assembly, 11, when full tension is applied to string, 20,. Tune string, 20, to A an octave below the existing fifth or A string of the guitar, 24,.

By pulling the unitized spool and lever, 11, from rear limiting arm, 15, position to the tone of E, said bass string 20, will untune itself through the tensing of the string, 20, process. Readjust tension of string, 20, until the proper tuning of A maintains itself in the normal rear limiting arm, 15, position. A speedier method of tuning would be to pre-stretch the string, 20, by hand while attached to the guitar, 24, and Pace Bace assembly by securely holding the guitar, 24, and pulling the string, 20, outwardly from the body of the guitar, 24, until the key of A is maintained at the rear limiting arm, 15, position. To further accommodate the musician, and to simplify its operation, the Pace Bace is equipped with an optional forward limiting arm, 14,. FIGS. 1–2–3, which is set at the key of E one octave below E of the existing fifth or A string on the guitar, 24, at the seventh fret. This tuning will automatically encompass the proper bass tones most commonly used, regardless of the key the music is written in, while sustaining the proper chord position. Without the forward limiting arm, 14, a broader range of bass notes can be achieved as the musician requires. If preferred, an A or an E bass string can be used in place of the D string, 20,. The adjustable forward limiting arm, 14, should then be readjusted to a tone suitable to the musician. Adjustable forward limiting arm, 14, then must be set to stop at the proper second tone within the chord, using rear limiting arm, 15, as the first tone desired, as in the previous example, using the D bass string, 20.

By picking the bass string, 20, and strumming the chord and at the same time moving the musicians arm, FIG. 6, in a limited pendulum type motion on the guitar, 24,. Stopping at the proper bass notes encompassed by the optional forward limiting arm, 14, and the rear limiting arm, 15, a bass accompaniment can be achieved by the guitarist at the same time he sustains a chord on the same guitar, 20,.

Before setting and locking forward limiting arm, 14, with retaining screw, 19, and hex nut, 22, FIG. 3, the bass string, 20, should return to its tuning of A at rear limiting arm, 15, after unitized spool and lever, 11, tensions string 20, to E at the forward limiting arm, 14, position. A and E should remain properly tuned after several tension and release maneuvers with unitized spool and lever assembly, 11,.

After bass string, 20, maintains its tuning of A at rear limiting arm, 15, the adjustable forward limiting arm, 14, is set against the pre-grooved, pre-drilled portion of the rear limiting arm, 15, FIG. 3, and secured by hex nut, 22, and retaining screw, 19, at the bass note E. When the unitized spool and lever, 11, assembly is at its relaxed position at rear limiting arm, 15, it will have a musical sound of bass A. When the musician's arm at the elbow pulls the unitized spool and lever, 11, assembly FIG. 4, to the adjustable forward limiting arm, 14, the proper bass note E can be plucked. These two notes, A, at rear limiting arm, 15, position, and E at optional, adjustable forward limiting arm, 14, position, will maintain their proper tones when string, 20, has been tensed to its limit.

From the foregoing, it should be understood that this invention provides a simple, inexpensive, and effective arrangement for rapidly attaching and de-taching the Pace Bace to a guitar body without appreciable damage to same. While a preferred embodiment of this invention has been disclosed herein, reference is directed to the appended claims for the scope of protection to be afforded thereto.

I claim:

1. An arm operated tone variation device capable of being selectively attached to any one of several strings of a stringed musical instrument comprising:

a support plate having means for attaching the plate near the end of a string musical instrument body and adjacent one end of a plurality of strings mounted on said instrument;

said plate being provided with a slot extending across said plate transverse to the lengthwise direction of said strings when said plate is mounted on said instrument;

said slot having a length equal to at least the total spacing of the strings at their said one end;

a support shaft extending substantially perpendicularly from said plate in a direction away from said instrument;

means mounting said shaft in said slot at a selected position opposite the said end of any one of said strings;

a spool rotatably mounted on said shaft;

means connecting said one string end to said spool;

a lever fixedly mounted to said spool and having means engageable by a player's arm for moving said lever and rotating said spool in order to vary the tension and tone of said one string;

and stop means for limiting the movement of said lever.

* * * * *